US006407651B1

(12) United States Patent
Wulff et al.

(10) Patent No.: US 6,407,651 B1
(45) Date of Patent: Jun. 18, 2002

(54) TEMPERATURE COMPENSATED TUNABLE RESONANT CAVITY

(75) Inventors: Torsten R. Wulff, Medford; Shawn A. Hogan, Gold Hill, both of OR (US)

(73) Assignee: Kathrein, Inc., Scala Division, Medford, OR (US)

( * ) Notice: Subject to any disclaimer, the term of this patent is extended or adjusted under 35 U.S.C. 154(b) by 2 days.

(21) Appl. No.: 09/723,617

(22) Filed: Nov. 27, 2000

Related U.S. Application Data

(60) Provisional application No. 60/169,189, filed on Dec. 6, 1999.

(51) Int. Cl.[7] ..... H01P 7/04

(52) U.S. Cl. ..... 333/224; 333/207; 333/234; 333/235; 333/226

(58) Field of Search ..... 333/224, 223, 333/226, 207, 234, 235

(56) References Cited

U.S. PATENT DOCUMENTS

| | | | | |
|---|---|---|---|---|
| 2,103,515 A | | 12/1937 | Conklin et al. | 333/234 |
| 3,160,825 A | | 12/1964 | Derr | 330/49 |
| 4,019,161 A | | 4/1977 | Kimura et al. | 333/234 |
| 4,034,320 A | | 7/1977 | Heckman, Jr. et al. | 333/225 |
| 4,057,772 A | | 11/1977 | Basil, Jr. et al. | 333/229 |
| 4,156,860 A | | 5/1979 | Atia et al. | 333/229 |
| 4,207,548 A | | 6/1980 | Graham et al. | 333/225 |
| 4,292,610 A | | 9/1981 | Makimoto et al. | 33/222 |
| 4,423,398 A | | 12/1983 | Jachowski et al. | 333/229 |
| 4,460,878 A | | 7/1984 | Fouillet et al. | 333/207 |
| 4,488,132 A | | 12/1984 | Collins et al. | 333/229 |
| 4,521,754 A | | 6/1985 | Ranghelli et al. | 333/224 |
| 4,677,403 A | | 6/1987 | Kich | 333/229 |
| 4,933,652 A | | 6/1990 | Gaukel | 333/225 |
| 5,039,966 A | * | 8/1991 | Schmid et al. | 333/229 |
| 5,216,388 A | | 6/1993 | Dipoala | 331/96 |
| 5,589,807 A | | 12/1996 | Tang | 333/212 |
| 5,686,874 A | | 11/1997 | Piirainen | 333/234 |
| 5,850,169 A | | 12/1998 | Hietala | 333/232 |
| 5,889,803 A | | 3/1999 | Pfeiffer et al. | 372/34 |
| 5,905,419 A | | 5/1999 | Lukkarila | 333/202 |

FOREIGN PATENT DOCUMENTS

| | | |
|---|---|---|
| DE | 28093623 A1 | 11/1978 |
| FR | 2342564 | 9/1977 |
| SE | 7802482-5 | 9/1980 |

* cited by examiner

*Primary Examiner*—Robert Pascal
*Assistant Examiner*—Stephen E. Jones
(74) *Attorney, Agent, or Firm*—Flehr Hohbach Test Albritton & Herbert LLP

(57) ABSTRACT

A tunable resonant cavity including a cavity housing having top and bottom walls with a post disposed in said cavity extending from die bottom of the cavity toward and spaced from the top. The length of the post is adjustable to adjust the resonant frequency of the cavity. The materials forming the resonant cavity are selected to provide temperature compensation.

4 Claims, 2 Drawing Sheets

TEMPERATURE COMPENSATED TUNABLE RESONANT CAVITY

RELATED APPLICATIONS

This application claims priority to Provisional Application Ser. No. 60/169,189 filed Dec. 6, 1999.

BRIEF DESCRIPTION OF THE INVENTION

This invention relates generally to resonant cavities and more particularly to temperature compensated tunable resonant cavities.

BACKGROUND OF THE INVENTION

An RE resonant cavity (or multiple interconnected cavities) can be used to create a RF filter. The filter may either pass a RF signal over a limited frequency range (a bandpass filter) or exclude an RF signal over a limited frequency range (a notch or bandstop filter), depending upon how the resonator is connected to the overall system. A perfect single cavity device would operate at a single, specific frequency (the resonant frequency), however due to material and other considerations all resonant frequency devices operate over a frequency range which encompasses the resonant frequency. Usually, it is desired to pass energy over a broad band of frequencies while blocking energy above and below this frequency range. This is achieved by combining or coupling multiple cavities. This causes the frequency response curve to widen. In addition, multiple filters with separate resonant frequencies can be connected together to form a duplexer. A duplexer is a device with, for example, two filters operating at different resonant frequencies and having one output in common.

A single-cavity RF resonator for use either individually or as part of an array of cavities is realized by having a conductive inner conductor or post within an enclosed conductive cavity. The post is connected to the housing at one end and extends towards die top of the cavity. The conductive cavity is formed within a conductive housing and enclosed by a conductive lid. The resonant frequency of the cavity is selected by adjusting the length of the post. Prior art systems for adjusting the length of the post have been relatively complex. In addition, in order to realize a system that is stable over temperature variations it is necessary to minimize the change in resonant frequency with respect to thermal variations of die system.

OBJECTS AND SUMMARY OF THE INVENTION

It is an object of the present invention to provide a resonant cavity of the type having a conductive post with an improved adjustment mechanism.

It is another object of the present invention to provide a temperature compensated tunable resonant cavity.

The foregoing and other objects of the invention arc achieved by a tunable cavity which includes a conductive post assembly comprising a post extending upwardly from the bottom wall, a bellows having one end secured to die top of the post, a top secured to the other end of the bellows, said top including an internal thread, and an adjustment screw extending upwardly from the bottom and threaded into said top. A spring is disposed between the top of the post and the top serving to urge them apart and to securely seat the adjustment screw.

BRIEF DESCRIPTION OF THE DRAWINGS

The foregoing and other features of the invention will be more clearly understood from the following description when read in conjunction with the accompanying drawings in which.

DESCRIPTION OF PREFERRED EMBODIMENT(S)

Figure 1:
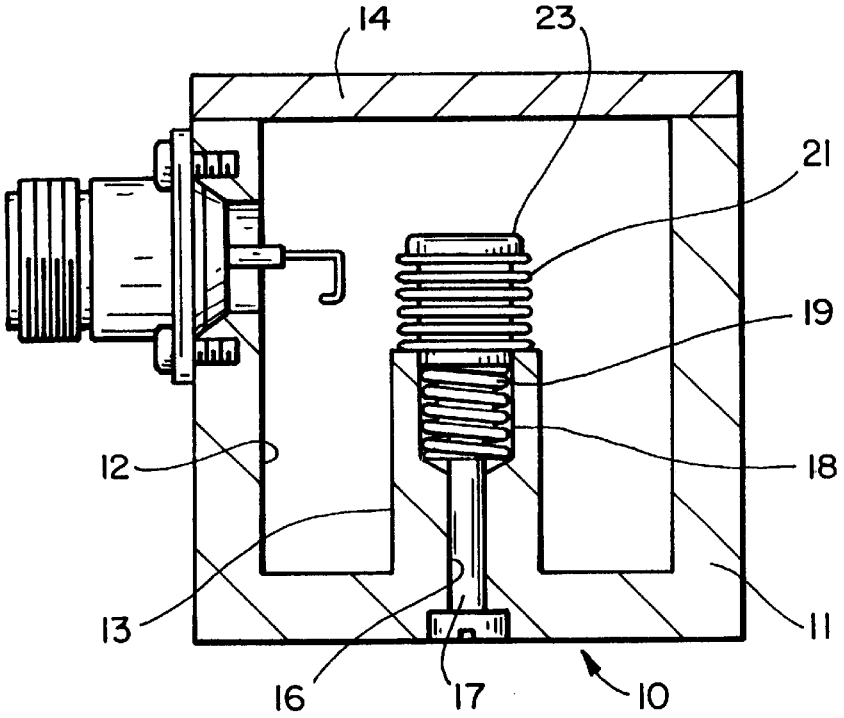
FIG. 1 is a sectional view of a temperature compensated tunable resonant cavity.

Referring to the figures, the cavity resonator 10 includes a housing 11 which can be formed by machining or by casting aluminum or other metal. An alternative would be to mold the housing from plastic and provide the interior wall 12 with a conductive coating. In the present example, the housing is formed to include a conductive post 13 which extends upwardly towards the top 14. The post includes a central bore 16 adapted to receive adjustment screw or bolt 17 and an enlarged well 18 adapted to receive a spring 19. The inner conductor or post may be integral to the housing as shown, or an added component. A bellows 21 has one end rigidly fixed to the top of the center conductor 13 and its other end rigidly fixed to a top 23. The top 23 contains a threaded bore (not shown) which receives the adjustment screw 17 which passes through central bore 16, spring 19 and bellows 21, whereby rotation of the screw adjusts the distance between the upper surface of die top 23 and the top 14 of the cavity, thereby controlling die frequency of operation. The spring serves to pre-load the adjustment screw against the bottom of the housing.

As shown, the resonant cavity and the conductive post are circular in shape. However, it is well known that cavities can be of substantially any shape, for example square, rectangular, oblong or the like.

The bellows is rigidly fixed to the top of die inner conductor and to the top by soldering, brazing, welding or any other acceptable method of securement. The adjustment screw is used to move the bellows top to adjust the length of the center conductor or post and therefore the resonant frequency. The bellows top 23 does not rotate as the adjustment screw is turned. It moves in an axial direction, either extending the post or shortening the post. The bellows serves to absorb the changing length of the bellows top while maintaining a conductive path over the full length of the post. The spring serves to pre-load the adjustment screw against the housing.

The assembly is temperature compensated, whereby changes in dimensions and lengths of the various components due to temperature variations does not change the resonant frequency. The change in resonator length ($L_{Res}$) of the center post due to a temperature change is governed by the change in length of the adjustment screw ($\Delta L_l$), the change in length of the bellows top ($\Delta L_M$), and the change in length of bottom section of the housing between the shoulder of die adjustment screw head and the bottom of the cavity ($\Delta L_B$). The resonant length $\Delta L_{Res}$ is equal to $\Delta L_l + \Delta L_M - \Delta L_a$. Where the change in length of a particular item is given by $\Delta L_x = L_x a_x \Delta T$; where $L_x$ is the length of a particular item (such as the adjustment screw, bellows top, etc.) at a reference temperature, $a_x$ is the coefficient of thermal expansion of the items material, and $\Delta T$ is the temperature change from the reference temperature.

in one example, the adjustment screw was made of Invar steel (a material having a very low coefficient of thermal expansion), the housing and inner conductor were made of aluminum (a material having a relatively high coefficient of thermal expansion), and the bellows top 23 was made of brass (a material having a coefficient of thermal expansion between that of Invar and aluminum). Careful selection of the materials and nominal lengths of the three items controlled the change in length ($L_{Res}$) of the resonator. However, it is possible to realize the same performance using a steel screw, a brass bellows top, and an aluminum housing, the dimensions for the parts just need to be adjusted correctly. The combination of an invar adjustment screw, brass bellows top, aluminum housing is the preferred embodiment.

The material of the bellows and inner conductor, and their associated length changes, is irrelevant since the bellows absorbs these changes in length and does not influence the bellows top. Strictly speaking there would be an extremely small influence proportional to die ratios of the spring rate of the bellows to the spring rate of the adjustment screw/bellows top combination. The effect is on the order of nanometers at best.

Figure 3:
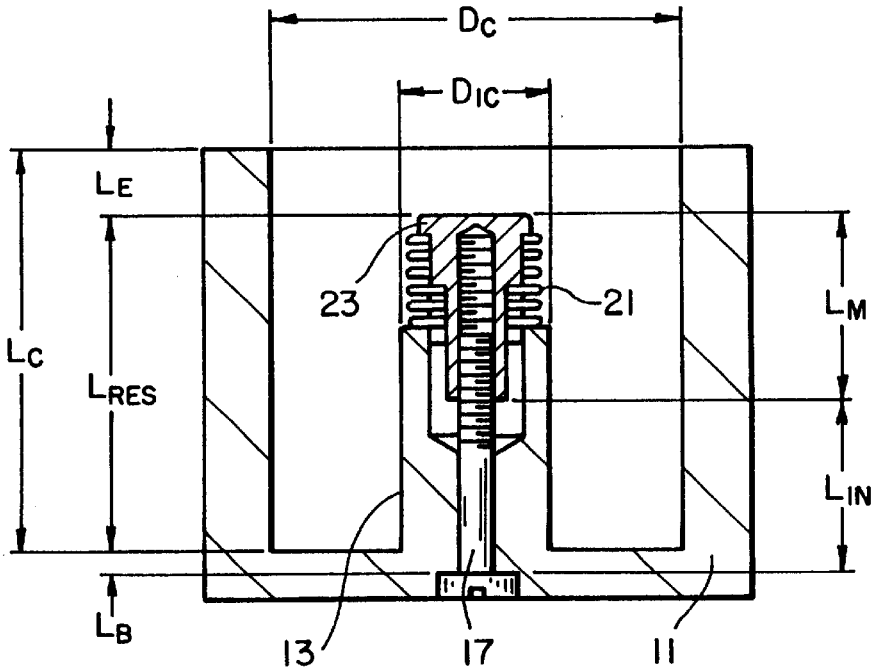
FIG. 3 shows the parameters for the thermal calculations required to provide temperature compensation.
Figure 2:
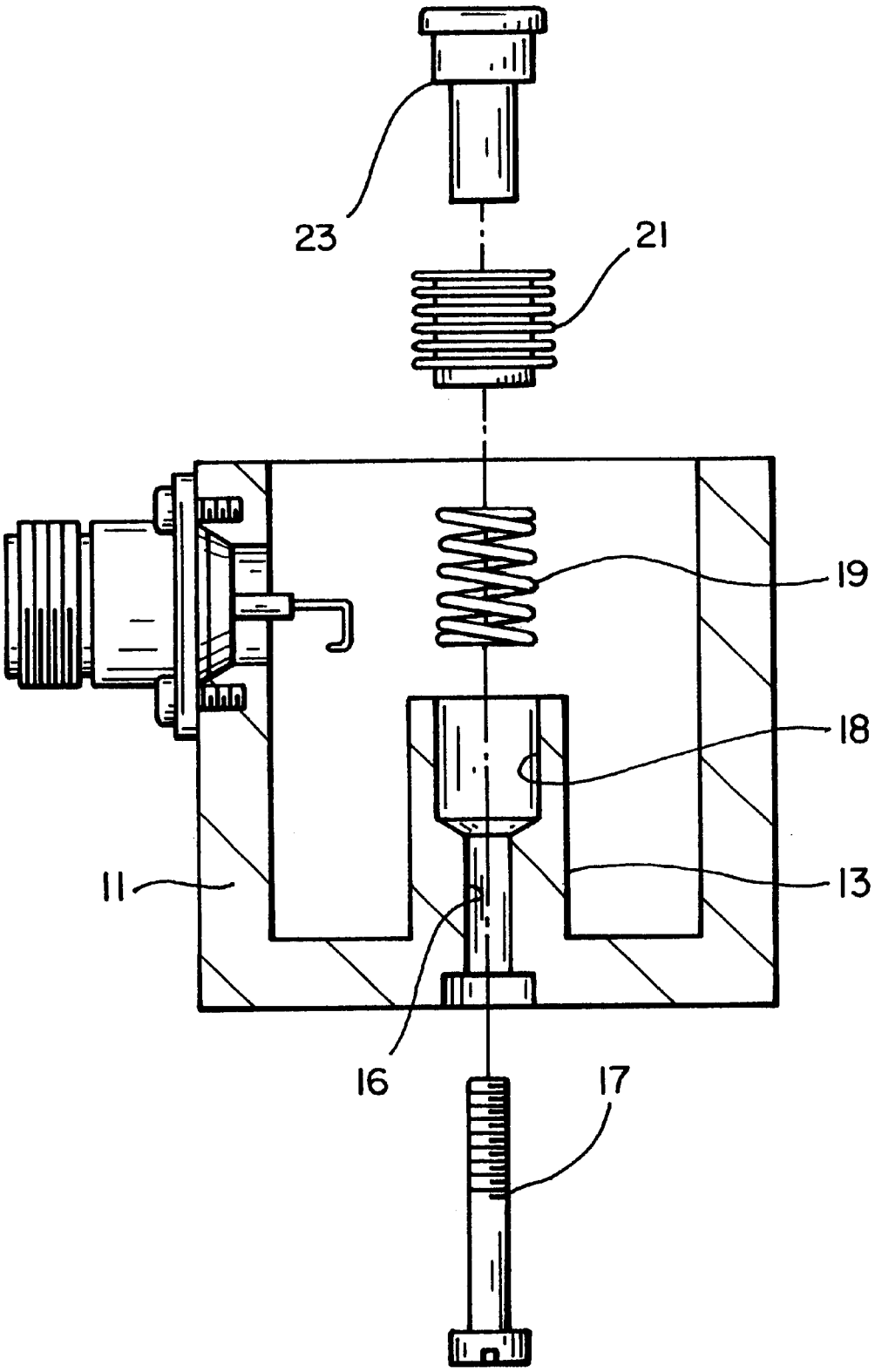
FIG. 2 is an exploded view of the resonant cavity of FIG. 1 with the top not shown

The resonant frequency is not simply determined by the length of the post. The electric field between the post and the lid and the electromagnetic field between the post and the housing also influence the resonant frequency. Therefore, it is simply not satisfactory to determine the lengths of the three items (adjustment screw, bellows top, and housing) to minimize the change in the resonator length ($L_{Res}$). To correctly minimize the change in resonant frequency due to temperature changes it is necessary to balance the change in resonator length ($L_{Res}$) with the change in distance between the post and the lid ($L_E$) and the change in the lateral dimensions of the housing and the post ($D_C$ and $D_{IC}$), FIG. 3.

By making the inner conductor and the housing of the same material the changes in the lateral dimensions of the housing and the post do not influence the change in the resonant frequency. By eliminating the influence of the lateral dimensions to the change in the resonant frequency it is only necessary to determine the appropriate values of $\Delta L_{Res}$ and $\Delta L_e$. Regardless of which combinations of materials are selected, it is necessary to determine the appropriate nominal lengths of the adjustment screw, bellows top and housing base from either simulation, closed form calculations, or experimental testing Another benefit with the present device is that the bellows provides for a longer electrical length of the inner conductor, due to the convolutions of the bellows. Therefore, a real quarter-wavelength resonator is realized in a shorter overall housing height while maintaining a large distance between the top of the inner conductor and the lid. The large distance between the top of the inner conductor and the lid provides for greater voltage stability, i.e., the device is able to handle higher power levels. Similar devices having the same overall housing height would require the top of the inner conductor be located very near the lid, providing poor voltage stability.

The foregoing descriptions of specific embodiments of the present invention are presented for the purposes of illustration and description. They are not intended to be exhaustive or to limit the invention to die precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A tunable resonant cavity comprising a housing, a cavity formed in said housing, a conductive post assembly extending upwardly from the bottom of the cavity, said conductive post assembly including:

a post having one internal bore, a bellows having one end secured to said post, a top secured to the other end of the bellows, said top including an internal thread, an adjustment screw extending upwardly from the bottom through said bore and threaded into said top, and a spring between the top of the post and the top serving to urge them apart, thereby seating the adjustment screw.

2. A resonant cavity as in claim 1 in which the material of said post, top and adjustment screw arc selected to compensate for thermal expansion and contraction to maintain the resonant frequency.

3. A resonant cavity as in claim 2 in which said post is aluminum, said top is brass and said screw is of a material having a relatively high coefficient of thermal expansion.

4. A resonant cavity as in claim 2 in which the material of said post arid housing are the same.

* * * * *